United States Patent [19]

Zoike et al.

[11] 4,172,641

[45] Oct. 30, 1979

[54] PHOTOTYPESETTER

[76] Inventors: Helmut M. Zoike, 4068 Via Laguna, Santa Barbara, Calif. 93110; William T. Heyer, 1585 La Coronella, Santa Barbara, Calif. 93109

[21] Appl. No.: 880,696

[22] Filed: Feb. 23, 1978

Related U.S. Application Data

[63] Continuation-in-part of Ser. No. 733,027, Oct. 15, 1976, abandoned.

[51] Int. Cl.[2] ..... B41B 17/00

[52] U.S. Cl. ..... 354/10; 354/16

[58] Field of Search ..... 354/5, 10, 12, 14, 15, 354/16; 355/86, 100

[56] References Cited

U.S. PATENT DOCUMENTS

| | | | |
|---|---|---|---|
| 2,742,830 | 4/1956 | Wirtz | 354/12 |
| 3,286,608 | 11/1966 | Friedel | 354/14 |
| 3,590,705 | 7/1971 | Moyroud | 354/10 |
| 3,626,830 | 12/1971 | Sobottka et al. | 354/12 |
| 3,688,672 | 9/1972 | Hanson et al. | 354/10 |
| 3,774,520 | 11/1973 | Smith et al. | 355/100 |
| 3,821,753 | 6/1974 | Sinnott et al. | 354/15 |
| 3,827,063 | 7/1974 | Sinnott et al. | 354/15 |
| 3,828,359 | 8/1974 | Vogelgesang et al. | 354/15 |
| 3,914,775 | 10/1975 | Vogelgesang et al. | 354/15 |

*Primary Examiner*—Russell E. Adams
*Attorney, Agent, or Firm*—Robert G. Slick

[57] ABSTRACT

A phototypesetter is provided for typing various texts in a wide range of type sizes from a single font or from a multiple font. A light sensitive, heat developing paper is used. In one embodiment of the machine, the paper is developed one line at a time so that the compositor can type the next line while the previous line is being developed. In accordance with another embodiment of the machine, a memory and display are provided wherein the compositor can type an entire page, edit it, and then print and develop the entire page by keying in the proper commands.

11 Claims, 30 Drawing Figures

PHOTOTYPESETTER

REFERENCE TO RELATED APPLICATION

This application is a continuation-in-part of application Ser. No. 733,027 filed Oct. 15, 1976, now abandoned.

SUMMARY OF THE INVENTION

Phototypesetter machines have been known in the past but none has been satisfactory for use by a small business or the like in the making of advertising signs and similar promotional materials which needs type of different sizes. Ordinarily such machines do not allow a wide selection of type sizes or, if they do, involve expensive equipment. Further, such machines have to have a separate wet process developing machine to develop the strip of output paper under semi-darkroom conditions. Usually a "paste-up" is made of the headlines strips and copy material, photographed, and then developed, fixed and dried. This machine will be able to combine all the above machines and operations in one single machine.

It is thus an object of the present invention to provide a relatively simple, mechanical phototypesetting machine which is capable of preparing signs, printed material, and the like in a wide variety of type sizes from a single font.

In accordance with another embodiment of the invention, two or more different fonts can be used, e.g. a small letter font of 6–30 points and the other a big letter font of 18–90 points. They could also be located on the same font if only upper case letters for the big sizes are required. The small font can accomodate two or three different styles of letters so that different styles can be printed in a large number of sizes without exchanging the font.

Another object of the present invention is to provide a phototypesetter wherein the developing is done one line at a time so that the compositor can type the next line while the previous line is being developed, and so save time in preparing the material.

In accordance with another embodiment of the invention, a memory and display unit is provided wherein a display is provided so that the compositor can type an entire page, edit it, and then have the entire page printed automatically thereafter and then have the entire sheet developed at one time.

Another object of the present invention is to provide a novel combination of paper advancing and developing mechanism of simple and fool-proof operation.

Still another object of the present invention is to provide a correction means for the type font position so that the stepping motor line up the font to only the approximate location desired, and the correcting mechanism will insure accurate alignment.

Still another object of the present invention is to provide a font for a phototypesetting machine wherein the opaque parts of the font are highly reflective so that the font will not be heated unduly by incident light.

A still further object of the present invention is to provide a novel means of shifting between lower case and upper case letters.

Still another object of the present invention is to provide simple means to automatic focusing the lens when the magnification selector knob is turned.

Other objects and features of the invention will be brought out in the specification which follows.

DESCRIPTION OF THE PREFERRED EMBODIMENTS

Figure 1:
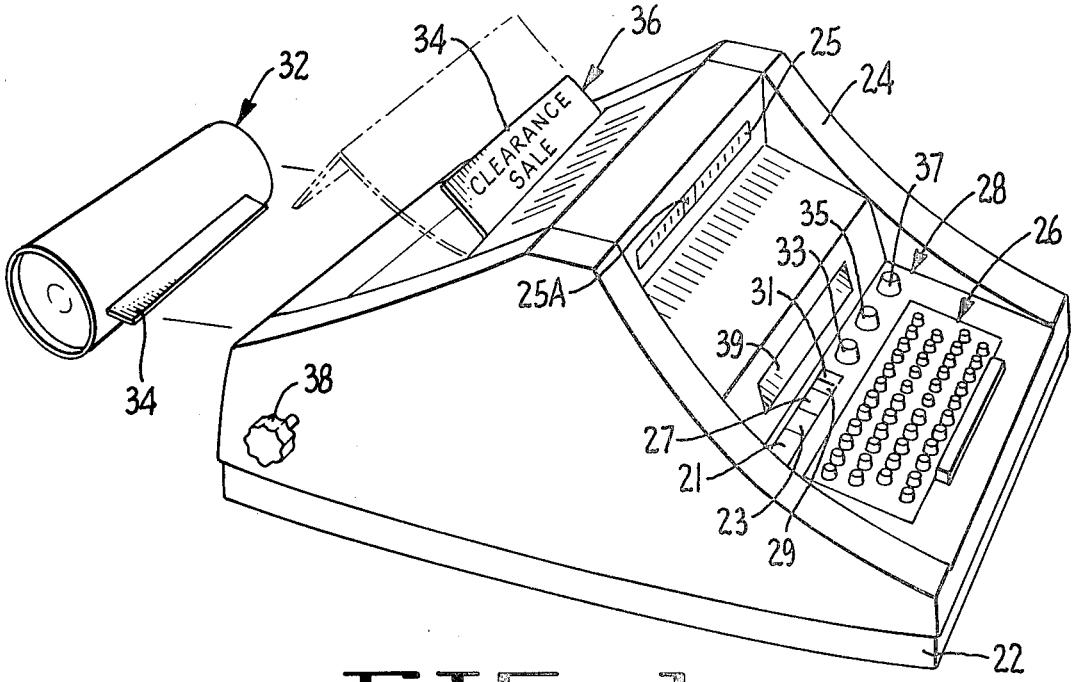
FIG. 1 is a perspective view of a phototyper embodying the present invention.
Figure 2:
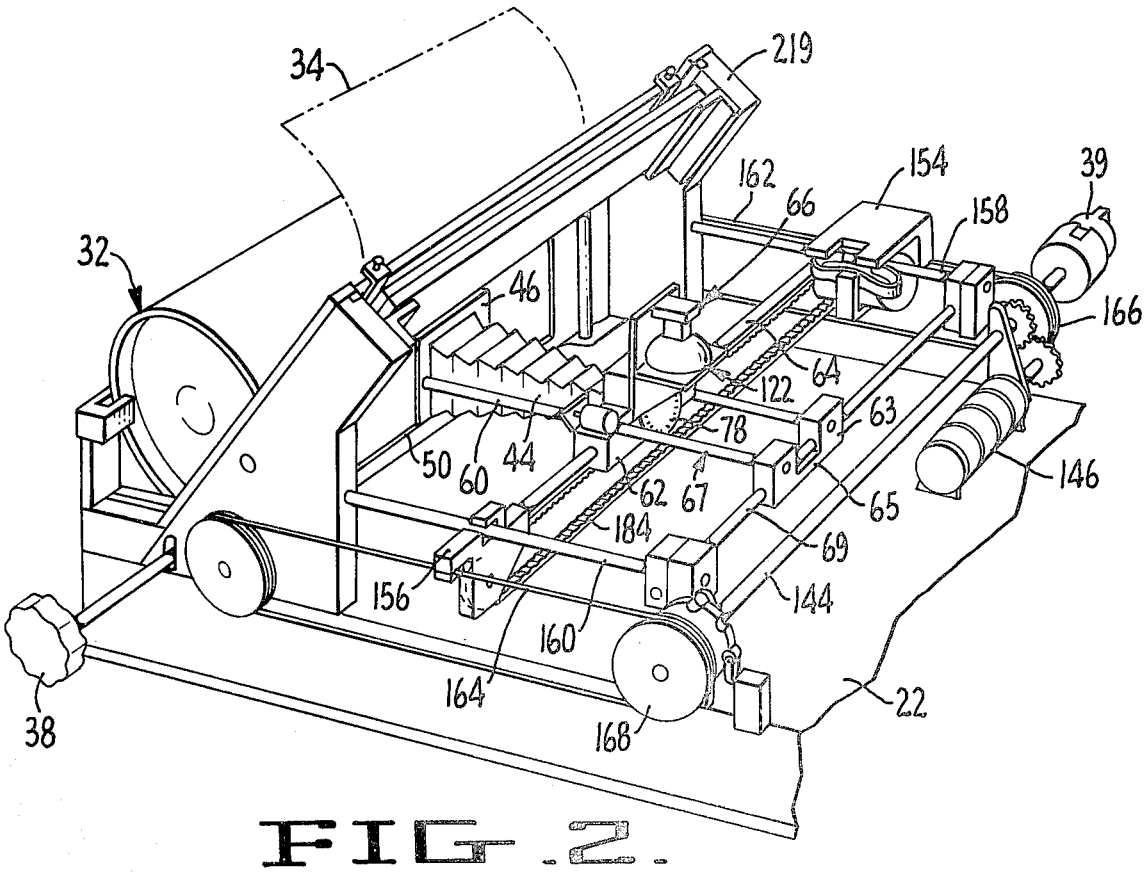
FIG. 2 is a view similar to FIG. 1 showing the machine with the cover removed.
Figure 3:
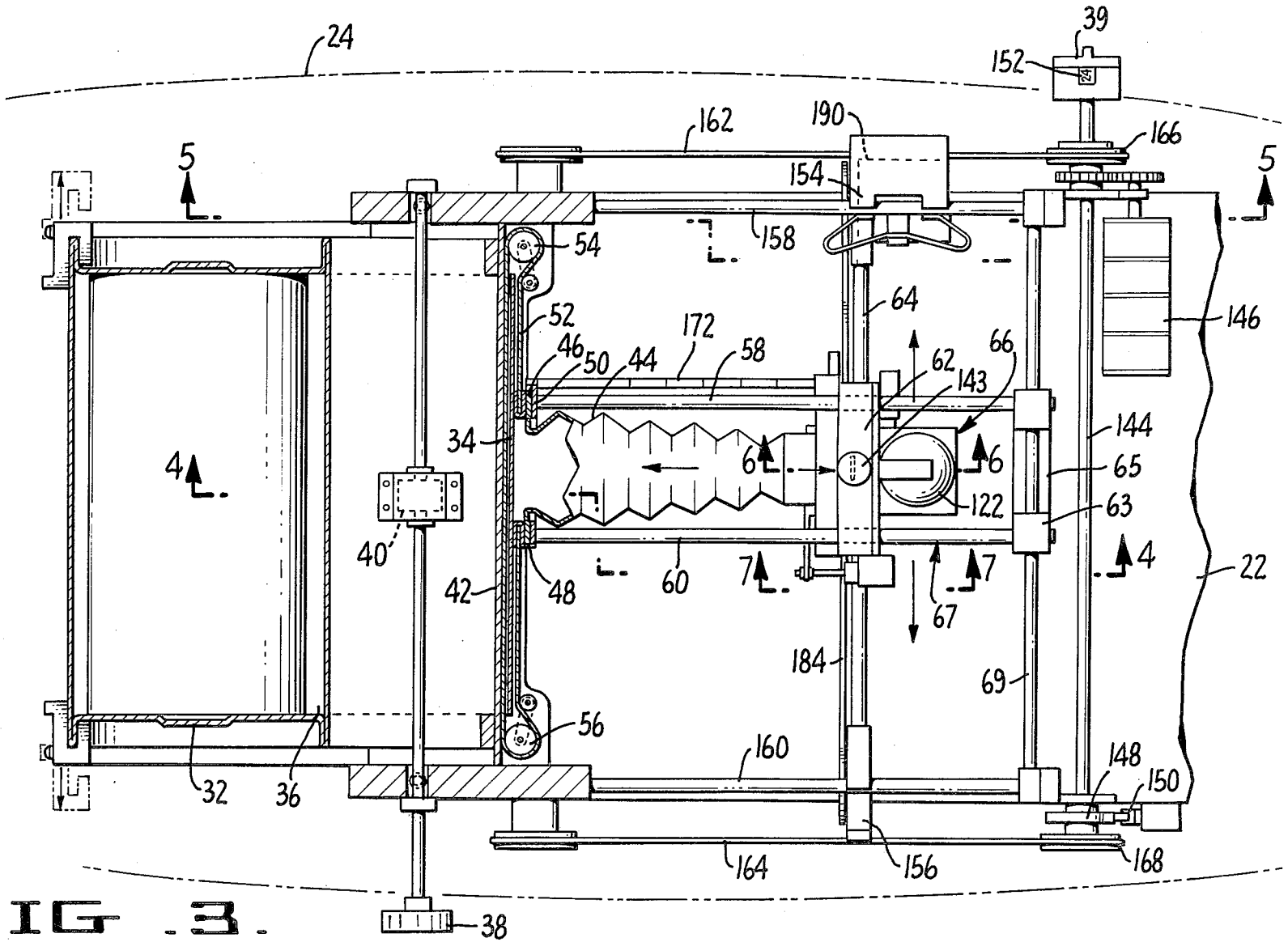
FIG. 3 is a plan view, partly in section, of the operating parts of the machine.
Figure 4:
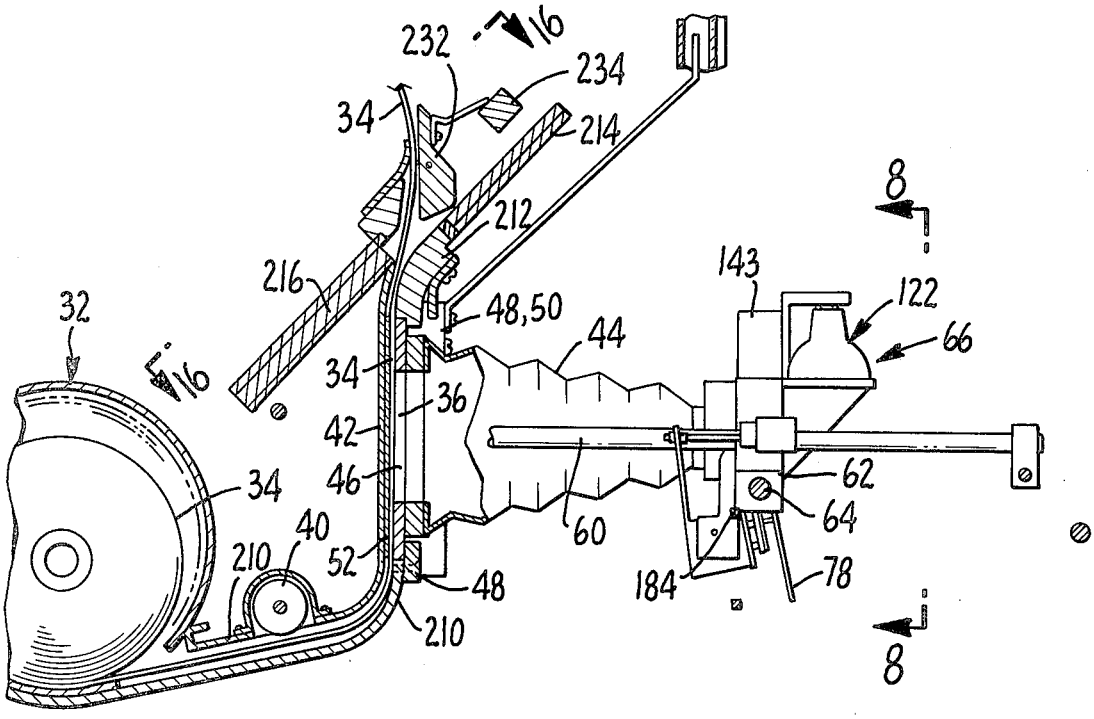
FIG. 4 is a section on the line 4—4 of FIG. 3.

The machine of the present invention as shown in FIGS. 1–22 is built on a base 22 having a suitable cover 24 thereover. The machine is provided with the usual typewriter keyboard 26 and with a suitable control panel 28. The control panel 28 has a number of lighted push button switches which control different features of the machine. The functions are preferably color coded with different lights to help the operator in the operation of the machine. In sequence from left to right of FIG. 1, the switches have the following functions:

(a) Power "ON" switch 21—This switch controls primary power to all machine functions which are delivered by the multiple output power supply unit, not illustrated. When switched on, it lights up in a green color.

(b) Carriage speed switch 23—With this selector switch the operator selects the speed of the carriage 62 on rods 64 and 69 (later described in detail). The operator can select two speeds, either fast or slow. The slow speed helps in locating the carriage in a precise position for left hand justification or a kearning operation between letters. The operator moves the carriage at slow stepping speed until the carriage position indicator 25 is in the desired position. Then he switches the selector switch to the fast operation position, and the carriage runs in fast speed. The slow speed position is shown in red light, and the fast speed position in green light through the translucent key.

(c) Shutter switch 27— With this selector switch the operator selects an "OPEN" or "CLOSE" shutter position. In the closed operation he can compose his text or copy in its position, and spacing with the different sizes of letters until he has the right composition without the actual exposure of the paper. When in "OPEN" position, the shutter opens during the typing operation sequence. The "CLOSED" position is indicated by a red light, and the "OPEN" position by a green light, both lights (not illustrated) being located under a translucent key.

(d) Leading switch lever 29—The leading selector switch alloys selecting the spacing between words. There are two choices, namely 2 spaces or 3 spaces. Both positions are indicated by a white light. The two positions show as 353 and 355 on FIG. 21.

(e) Line spacing 31—The line spacing selector switch allows selecting the spacing between typed lines in two choices, namely "narrow" and "wide". Both choices are indicated by a white light.

(f) Paper sensitivity potentiometer 33

(g) Development temperature potentiometer 35

(h) Development time potentiometer 37

(i) An alpha numeric indicator 39 is provided to indicate the letters which just have been typed in the present line of letters. It retains the letters until the return key or the paper advancement key has been pushed, which clears the line, so that the next line can be displayed.

A light tight cassette 32 provides a supply of heat developable paper 34. The finished, developed paper leaves the machine at 36. A knob 38 actuates roller 40 for initially drawing the paper onto platen 42 where it is exposed while knob 39 sets the type (point) size.

Adjacent to the platen 42 are the bellows 44 which are provided with a light-tight frame 46 which is mounted in sliding relationship in front of the platen. The light tight frame 46 is mounted for traversing on the guides 48 and 50 which run from side to side in the machine. The frame 46 is attached to a curtain 52 which passes over rollers 54 and 56. The curtain element 52 serves as a light shield so that that portion of the sensitive paper which does not lie directly under the light shield 46 will not be exposed to stray light. Also attached to the frame 46 are rods 58 and 60 which extend on either side of the bellows to the carriage 62 and further to back carriage guide 63 which has a linear ball-bearing 65 attached to it, which in turn guides the whole carriage 62 on back guide rod 69 and the front guide rod 64. Rods 64 and 69 extend from side to side of the machine. The carriage 62 supports the font mechanism 66 later to be described in detail. The frame 46 and the attached structures are caused to traverse from side to side by means later described in detail.

Figure 6:
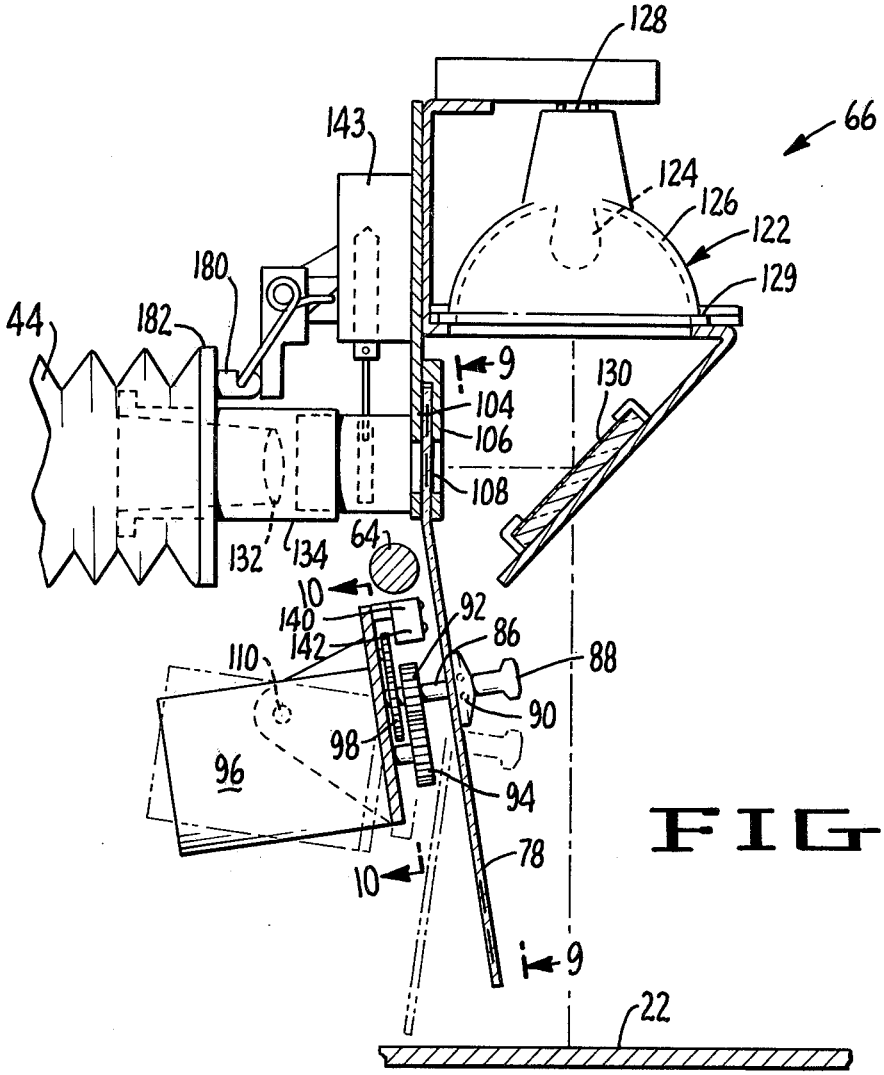
FIG. 6 is a section on the line 6—6 of FIG. 3.
Figure 10:
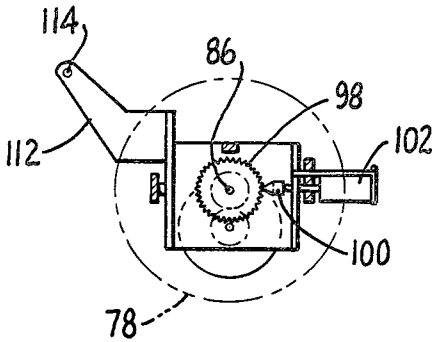
FIG. 10 is a section on the line 10—10 of FIG. 6.
Figure 9:
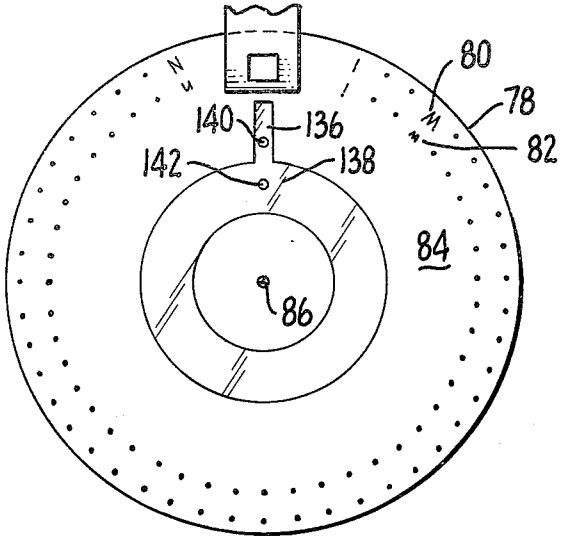
FIG. 9 is a section on the line 9—9 of FIG. 6.

The font mechanism, generally designated 66, will now be described in detail. The font proper consists of a disc 78 with two concentric rows of transparent characters, namely upper case characters 80 and lower case characters 82 near the periphery thereof. The face 84 of the disc 78 is provided with a reflective surface so that light will be reflected from the opaque parts of the disc, keeping the font from getting unduly warm. The font is attached to a shaft 86 and is held in place by a knob 88 which has detents 90 fitting into a recess in shafts 86 to make it easy to snap off one font and substitute another to change the style of type. Shaft 86 has a gear 92 which mates with gear 94 on stepping motor 96. Shaft 86 also carries a toothed wheel 98 as is best seen in FIG. 10. The number of teeth on wheel 98 corresponds to the number of characters in each row of font 84. Adjacent to wheel 98 is detent 100 which is actuated by solenoid 102. It is difficult to operate the stepping motor 96 with the extreme degree of precision required for the placement of the font so that the stepping motor rotates the font to bring it into approximately the desired position, and solenoid 102 is actuated, causing the detent 100 to enter between the two closest teeth on wheel 98 precisely positioning the font. The font itself is flexible and passes between gates 104 and 106 so that the character is maintained at the exact first focal plane as shown at 108. Stepping motor 96 is pivoted, as is best seen in FIG. 6. The pivot point is at 110 and the motor is actuated by lever arm 112 which in turn is attached to the armature 114 of solenoid 116 through a flexible cable 115.

Figure 7:
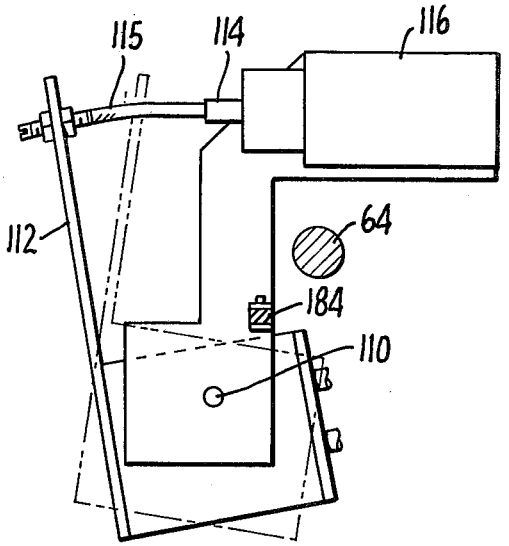
FIG. 7 is a section on the line 7—7 of FIG. 3.

Thus, referring to FIGS. 6 and 7, the position of the parts is shown in solid lines for printing a lower case character and in phantom for printing an upper case character. A light source 122 is provided which preferably consists of a halogen quartz bulb 124 with an attached reflector 126 with a snap-in connector 128, making it easy to snap in a new bulb and to position it precisely in holes 129.

Mounted below the light source 122 is a cold mirror 130 and light is reflected off this mirror onto the focal plane 108 as is shown in dot-dash lines in FIG. 6 and also passing the heat straight down to the base plate 22. A suitable objective lens 132 held in lens mount 134 focuses the image of the selected portion of the font onto the sensitive paper 36 held against platen 42 at the second focal plane.

The font also has two transparent areas 136 and 138, and light coming through these areas is sensed by the photocells 140 and 142. The area 136 and photocell 140 are used for determining a "home" position of the font, and photocell 142 through area 138 is monitoring the light intensity of the lamp. An automatic electronic exposure meter circuit senses the photocells 142 output, and through an integrating circuit with a capacitor switch when the predetermined exposure values have been reached. An operational amplifier then triggers a transistor which operates the electromagnetic shutter 143. Any variation in the lamp output due to aging or variation in line voltage or lamp exchange are herewith automatically compensated.

As was previously stated, the font motor assembly is mounted on carriage 62. Carriage 62 can move to the front and to the rear on the guides 58 and 60, and can move from side to side on the rod 64. The motion from front to rear obviously determines the size of the character printed, and this motion is controlled by shaft 144 which is controlled by knob 39. Rotary switches 146 serve to correct exposure light level and time as well as controls the width of the traverse steps and line spacing, depending on the degree of magnification and line spacing selected. Shaft 144 has a detent wheel 148 with a spring mounted detent 150 pressing against it. In this manner, the shaft 144 can stop at certain select points which will represent certain degrees of magnification of the font. This shaft also carries an indicator 152 which indicates the size of type, preferably in points, being printed. Rod 64 is mounted on sliders 154 and 156 which can slide on the rods 158 and 160. These sliders are attached to the cables 162 and 164 and pass over pulleys 166 and 168 mounted on shaft 144. Thus, the font assembly 66 can be moved back and forth in steps determined by the detent wheel 148 and this, of course, determines the size of the character printed.

Figure 11:
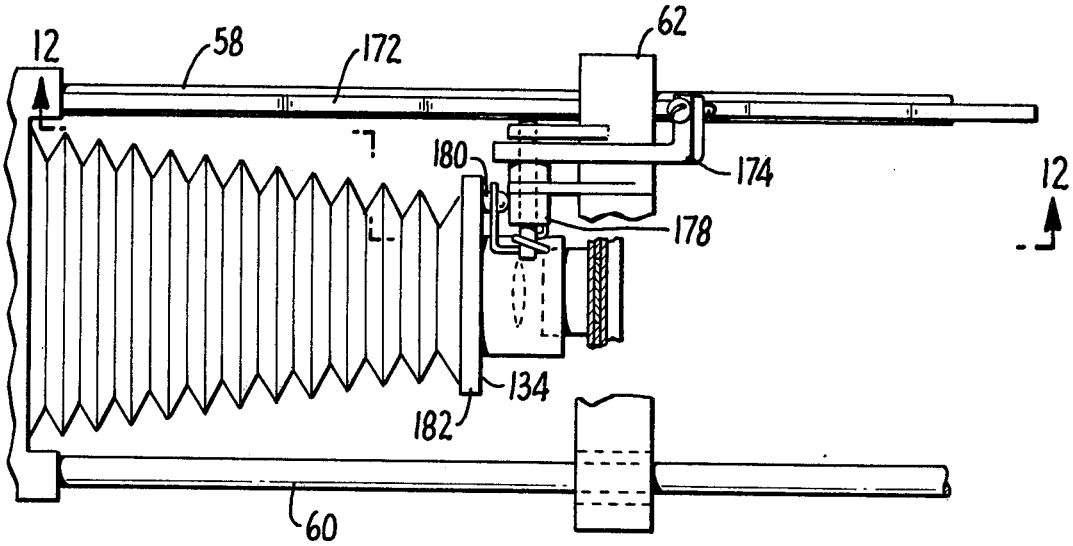
FIG. 11 is a top plan view of the auto-focus mechanism.
Figure 12:
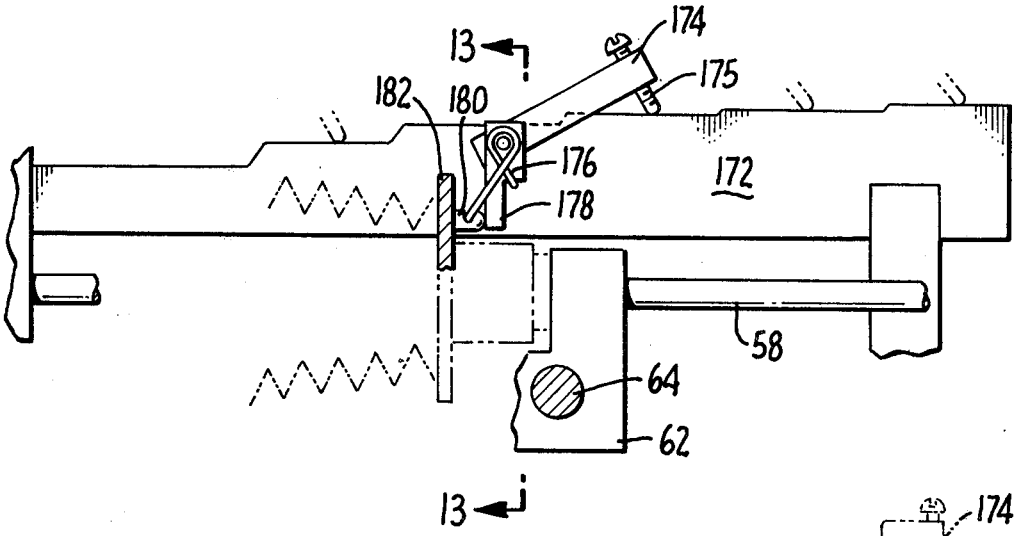
FIG. 12 is a section on the line 12—12 of FIG. 11.
Figure 13:
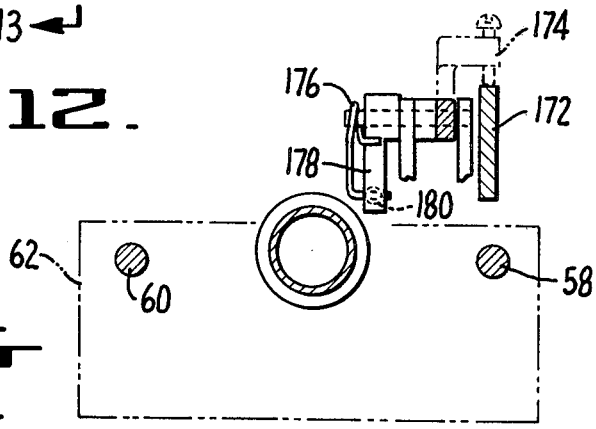
FIG. 13 is a section on the line 13—13 of FIG. 12.

The method of focusing the camera can best be seen in FIGS. 11, 12 and 13. Lying alongside of rod 58 is a cam 172. A cam follower arm 174 having adjustable cam follower 175 is urged into contact with the cam surface by means of spring 176. The cam follower has an arm 178 which is held in contact with pin 180 by spring 176. Pin 180 is fed through to housing 182 and connects to the objective lens holder 134 best seen in FIG. 6. Thus, as the carriage assembly 62 moves back and forth, the lens position changes to cause the image to stay in sharp focus by the action of cam 172.

Figure 8:
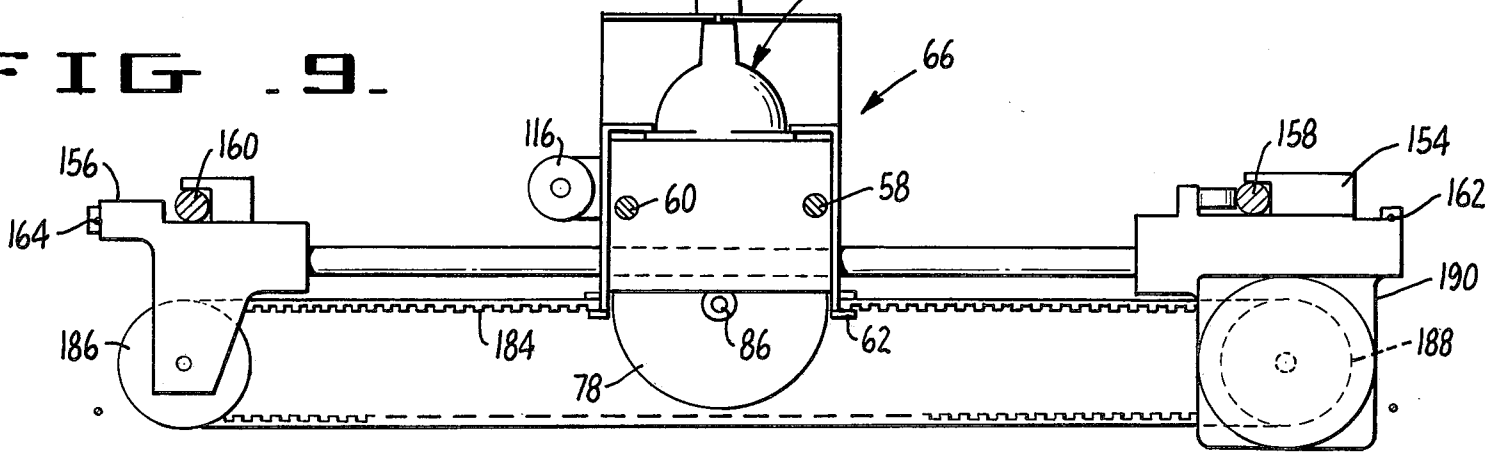
FIG. 8 is a section on the line 8—8 of FIG. 4.

As was previously mentioned, the carriage 62 can move from side to side on rod 64. This movement is obviously necessary so that one character can be exposed at a time and the carriage returned to the starting position after having printed a line. This side-to-side movement is controlled by the toothed belt 184 which is attached to the carriage 62 as is best seen in FIG. 8. The toothed belt 184 is trained around the pulleys 186 and 188. The position of the belt is determined by the stepping motor 190 and these steps are adjusted for the size of the image by switches 146. A carriage position pointer 25A and scale 25 is provided to indicate the position of the carriage in respect to the paper width. The paper width is shown in picas on the scale 25 by pointer 25A which is connected to the frame 46 and rides behind the transparent scale 25.

Figure 5:
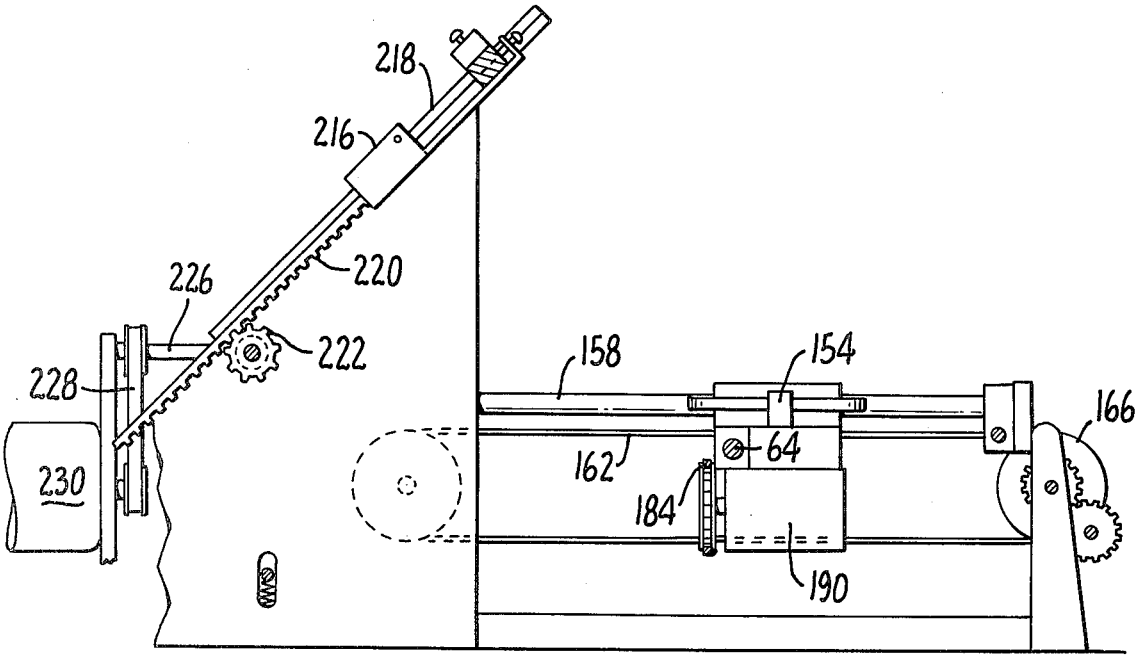
FIG. 5 is a section on the line 5—5 of FIG. 3.

As was previously mentioned, the phototypesetter of the present invention utilizes a light-sensitive, heat developable paper, and the method of advancing and developing the paper will now be described. The paper 34 is contained in cassette 32 and passes through a light-tight passage 210, past the roller 40 and up to the pressure plate 42, where the paper is exposed. After the paper is exposed, it passes over guide 212 in position to be moved into contact with the heater pad 214 where the developing takes place. Located over pad 214 is a heated pad 216 which is arranged for reciprocation on ways 218. It consists of an electrical heater 214 which has on its front surface a velours fabric 215 of the proper springiness and friction coefficient to adjust for irregular surface conditions and misalignment. On the back side of the heater is a polyurethane pad 217 for insulation purposes. A sensor in good physical contact with the heater element and an electronic temperature controller (not illustrated) keep the heater temperature slaved and controlled to the temperature of the heater plate 214, so that the paper is controlled in the front as well as in the back to the proper development temperature parameters. A rack 220 bearing against pinion 222 serves to reciprocate pad 216. The rack 220 is driven through the angle drive 224 from shaft 226 which is connected by a belt 228 to motor 230 as shown in FIG. 5. As the pad 216 advances, as is shown by the arrow in FIG. 14, it pulls the paper along with it since the paper is gripped by the swinging block 232 which is urged into contact with the paper by means of a friction bar 234. After the pad 216 has pulled the paper along to the desired extent determined by the selected photocell, motor 230 reverses, pulling the pad 216 backward, but at this point, the paper is released by swinging block 232 which is actuated by tab 233 riding up on friction bar 234 which is held back by friction pads 237 against ways 218. A sheet of silicon rubber 235 is affixed to the top of heater 214 and has a higher coefficient of friction than the heated pad 216 covered with velours fabric. Thus, the pad 216 slips over the paper so that the paper is held against rubber sheet 235 and thus is not pushed back into the printer. In this way, a simple means is provided to advance the paper one line at a time and simultaneously develop it by contact with the pad 214. A light emitting diode 215 is fastened to the slider 216, and projects its output to a row of phototransistors 217 fastened to frame 219. The slider moves to the photocell previously selected by selector switch 146, which is actuated by the point size selector knob 39, and stops the drive motor 230 through a solid state switching circuit. The motor 230 is a special "two motors on one axis" assembly which is essentially a drive motor and brake motor on the same shaft. It stops the motor in a very short time and distance and into a very repeatable position.

A delay timer sequence is electrically initiated which keeps the slider assembly with the backheater over the paper, and the development of the paper takes place. The duration of the development is selected by the control knob 37 and the heater plate temperature by the control knob 35. An additional control 33 is provided to adjust for the different light sensitivities of the papers by controlling the length of exposure time.

Two micro switches 369 and 371 are provided to stop the carriage travel electrically when the carriage reaches the two end positions left and right. This avoids mechanical overstresses in the drive system.

The power supply for the machine (not illustrated) is a multiple output supply which provides the necessary voltages for all the electrical functions to be performed. It is housed in a box which is located separate from the machine, to avoid electrical and thermal interferences. It connects to the machine via a power cable plug.

Figure 21:
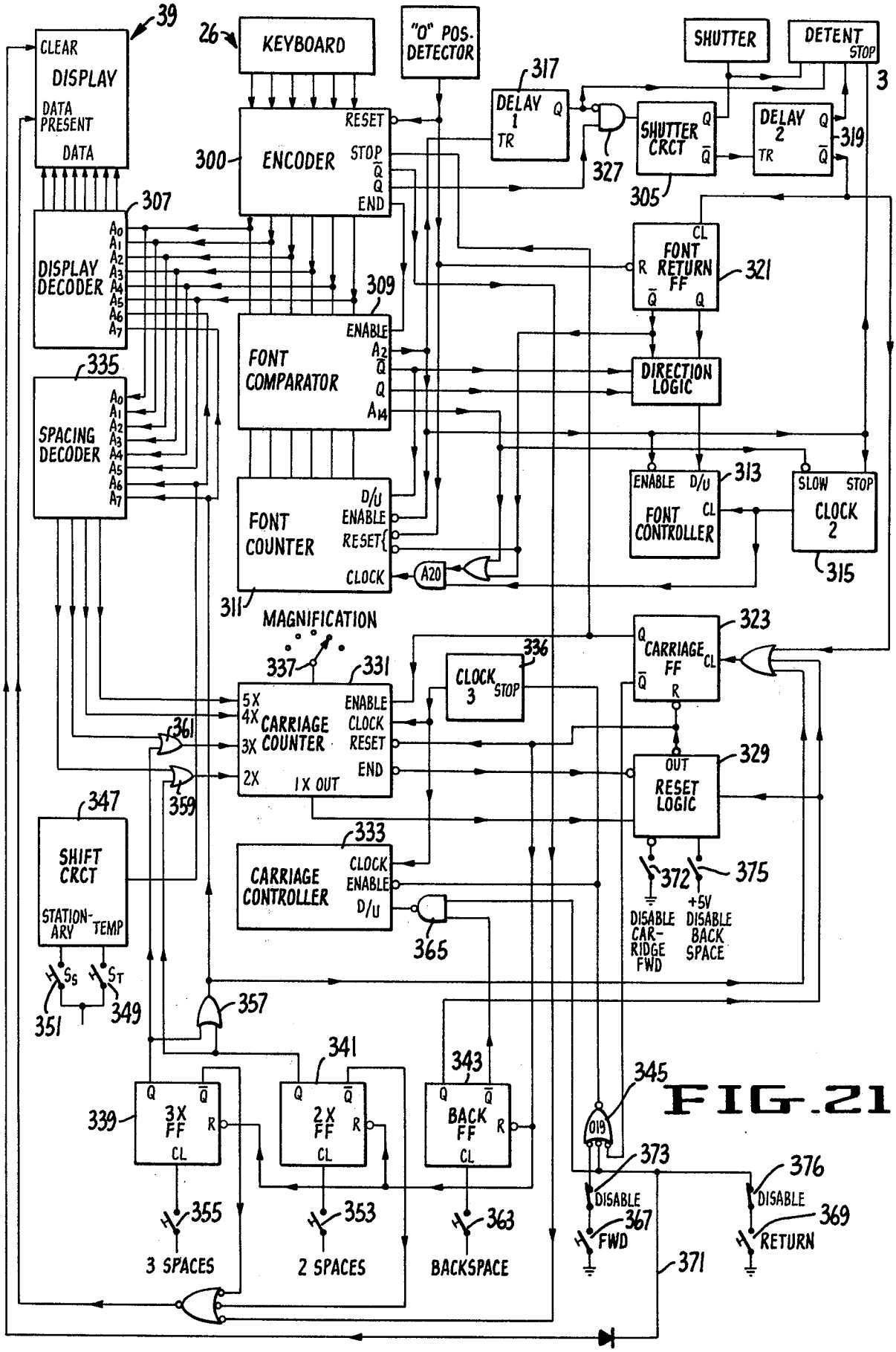
FIG. 21 is a schematic diagram of the font and carriage movement electronics.

The font and carriage movement sequence of events will now be described particularly with reference to FIG. 21:

LOWER CASE LETTER

Pushing a key on keyboard 26 stops the encoder counter 300 at a number which corresponds to the keyed-in letter. The output of 300 is set, enabling shutter circuit 305 and sending a "data present" signal to the display 39. The encoder output is decoded in 307 and applied to the display; the keyed-in letter appears on the display 307. The "end" signal enables the font comparator 309. The encoder output is applied to the font comparator causing the direction flip-flop FF2 of 309 to be set for that direction of the rotation of the font wheel 78 which corresponds to the keyed-in letter. A2 of 309 goes low, enabling the font counter 311 and controller 313 and removing the stop signal from clock 2 (315) and the detent circuit 317. The font wheel begins to move. Three steps before the wheel reaches the position corresponding to the keyed-in letter, A14 of 309 goes low, placing clock 315 into the slow mode.

When the number in the font counter 311 equals the number in the encoder 300, the output A2 of the font comparator 309 goes high, stopping font counter 311 and controller 311 and clock 2. It also triggers delay 1 (317) which activates the detent stop 317.

At the end of the delay 1 period, when the font wheel has come to rest, the shutter circuit 305 is activated. The shutter circuit also activates the detent 317.

At the end of the shutter period the shutter circuit trigers delay 2 (319) which allows enough time for the shutter to close completely. Delay 2 also activates the detent 317.

At the end of the delay 2 period the detent stop 317 is deactivated and the font return (321) and the carriage (323) flip-flops are set. The return FF 321 resets the font counter 311 to zero. This causes A2 of the font comparator 309 to go low, thereby enabling the font counter 311, starting clock 315 and disabling the detent 317. A14 of 309 now goes high, allowing the signal from clock 315 to reach the font counter 311. As the return FF 321 through the direction logic 325 has reversed the font controller direction, the font wheel begins to return to its "0" position.

Three counts before the font wheel reaches its "0" position A14 of 309 goes low and as $\overline{Q}$ of the return FF is also low, gate A20 is disabled and clock 2 (315) thus does no longer reach the font counter, it stops counting. The font controller, however, keeps receiving clock pulses and the font wheel keeps moving; it will only stop when the "0" detector detects the "0" position and resets the encoder; the font counter and the return FF, the font comparator are disabled causing A2 to go high. This disables the font counter, and the font controller, and stops clock 2. A2 also triggers delay 1 (317) but delay 1 cannot trigger the shutter circuit as the AND gate 327 at its trigger input is disabled by the Q output of FF1 (300) which was reset with the entire encoder. Now the encoder may, or may not, be ready for the next encoding cycle. This depends on whether the carriage has come to a standstill (carriage FF 323 reset). The encoder remains stopped until the carriage has stopped.

When delay 2 (319) at the end of its period triggered the return FF 321 and thereby started the return motion of the font wheel it also set the carriage FF. When the carriage FF is set it enables the carriage counter 331 and—through 019—enables the carriage controller 333 and starts clock 3 (336).

The carriage moves a number of steps which is equal to 2 times magnification spacing. The magnification is set by selector switch 337. The spacing depends on the keyed-in letter. Depending on the encoder output and the state of the shift circuit one of the 4 outputs of the spacing decoder 336 goes high determining the spacing as 2x, 3x, 4x or 5x.

When the counter has reached the number defined above it produces a low at its "end" output which through the reset logic resets the carriage FF 323, the spacing FF's 339 and 341, the back space FF 343 and itself. $\overline{Q}$ of the carriage FF 323 goes high causing OR gate 019 (345) to go high, stopping clock 3 and disabling the carriage controller. If the font has returned to its "0" position the encoder is ready for the next letter, otherwise the encoder remains stopped until it does reach its "0" position.

CAPITAL LETTER

The shift circuit can be activated in two ways: either by temporary switch 349 or stationary switch 351. To place it in the temporary mode $S_T$ (349) must be depressed; only as long as it is depressed will the font wheel be shifted into its upper case position. The font wheel remains in the upper case position after momentarily depressing $S_S$ 351 until $S_T$ is depressed when it returns into its lower case position. When activated, the shift circuit places a high signal on the A6 inputs of the display (307) and spacing (335) decoders. This causes the letter to be displayed as upper case and influences the spacing (count of carriage counter).

2x and 3x SPACING

Blank spacing is accomplished by depressing either the 2 spaces (353) or 3 spaces (355) switch. This causes the carriage to move to 2 or 3 times magnification in the following manner: 2x FF (341) or 3x FF (339) is set. Through OR gate 357, the carriage FF is set and the carriage starts moving. The output of the OR gate is also applied to the $A_7$ inputs of the display and spacing decoders. This causes a blank to be entered on the display and zeroes all four outputs of the spacing decoder; depending on whether the 2 spaces or 3 spaces switch was depressed the 2x or 3x line of the carriage counter is high (through the OR gates 359 and 361) and the carriage moves the corresponding number of steps. When the carriage counter reaches the proper count it causes resetting of the carriage FF and the spacing FF as in the case of a lower or upper case letter.

BACKSPACE

Depressing the backspace switch 363 sets the backspace FF 343 which in turn sets the carriage FF 323. This sets the carriage in motion as described above. However, as the $\overline{Q}$ output of the backspace FF goes low and the NAND gate 365 at the D/U input of the carriage controller goes high, causing the carriage controller to reverse the carriage motor. After a number of steps equal to 2 times magnification backward the 1x output of the carriage goes high and through the reset logic resets the circuits as in the case of a letter. Note that in this case it does not matter whether any of the outputs of the spacing decoder are high. Q of the backspace FF sets the reset logic so that it accepts a signal from the 1x output of the carriage counter.

CARRIAGE FORWARD

Depressing the FWD switch 367 causes 019 to go low, thereby enabling the carriage controller and starting clock 3. The carriage keeps moving forward as long as the FWD switch is depressed.

CARRIAGE RETURN

Depressing the return switch 369 causes 019 to go low thereby enabling the carriage controller and starting clock 3. 019 also causes the NAND gate 365 at the D/U input to go high, causing the carriage motor to reverse its direction. The carriage keeps moving backward as long as the return switch is depressed. Depressing the return switch also clears the display.

DISABLE SWITCH

When in the right-most position the carriage closes the disable carriage FWD switch 372 which through the reset logic keeps the carriage FF 323 reset. The carriage counter and the carriage controller are kept disabled even if a key is depressed. In the same position the carriage opens the FWD disable switch 373 making the FWD switch 367 inactive.

When in the left-most position the carriage closes the disable backspace switch 375 which through the reset logic keeps the carriage FF reset even when the backspace FF is set. In the same position the carriage opens the return disable switch 376 making the return switch 369 inactive.

Figure 22:
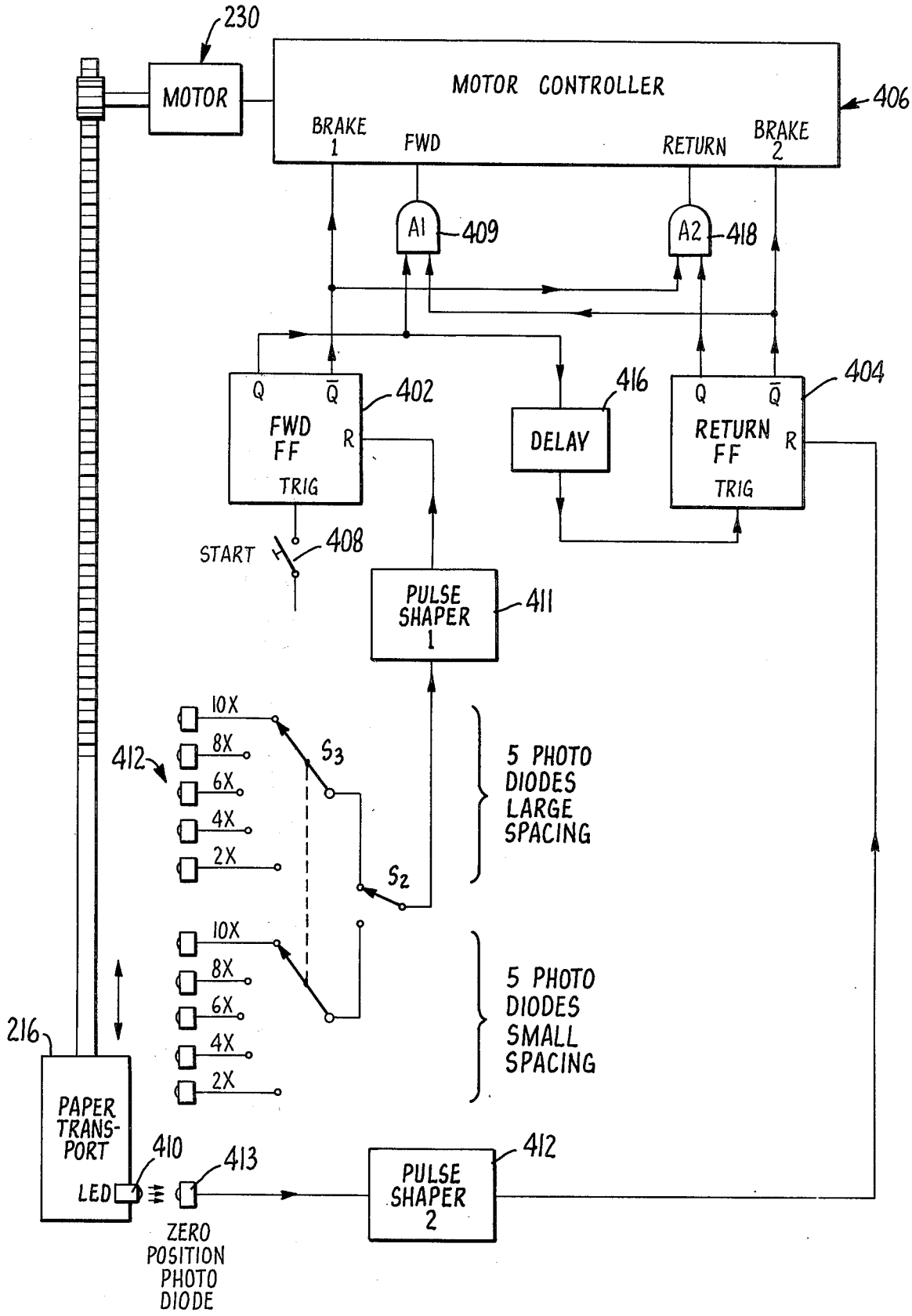
FIG. 22 is a schematic diagram of the paper advance electronics.
Figure 23:
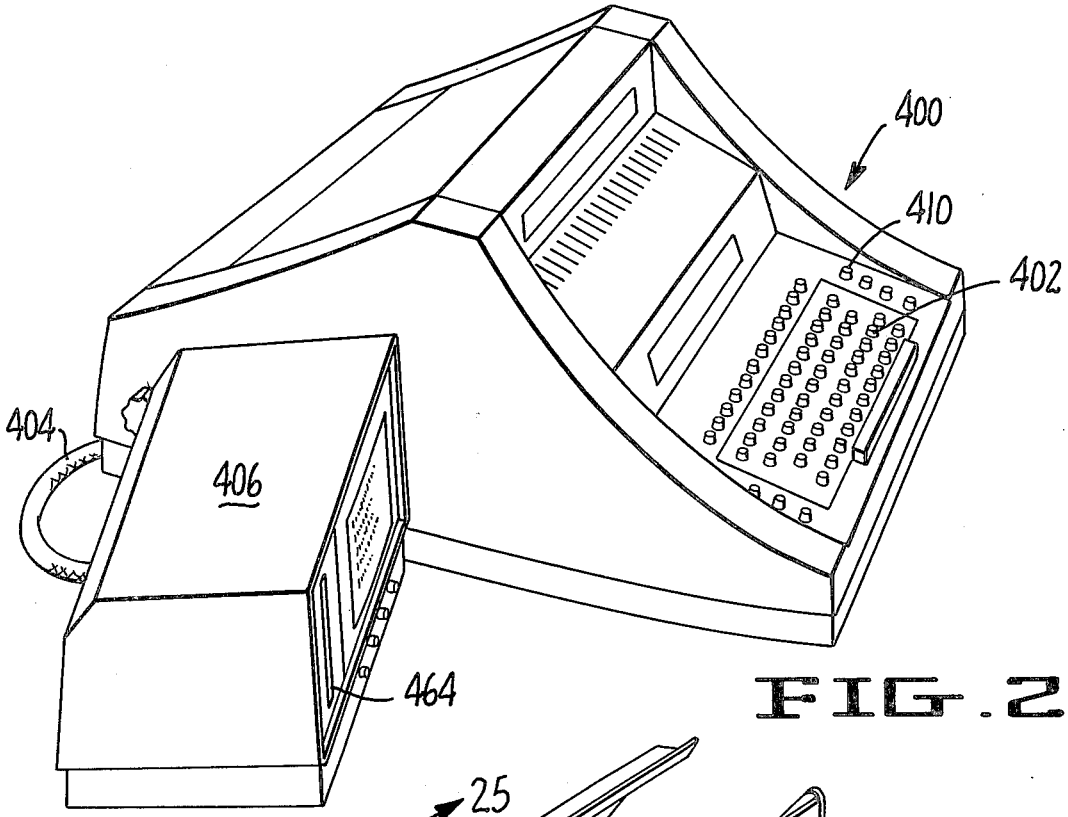
FIG. 23 is a perspective view of another embodiment of the invention employing a memory circuit and a CRT display and also wherein the machine develops an entire page at one time.
Figure 24:
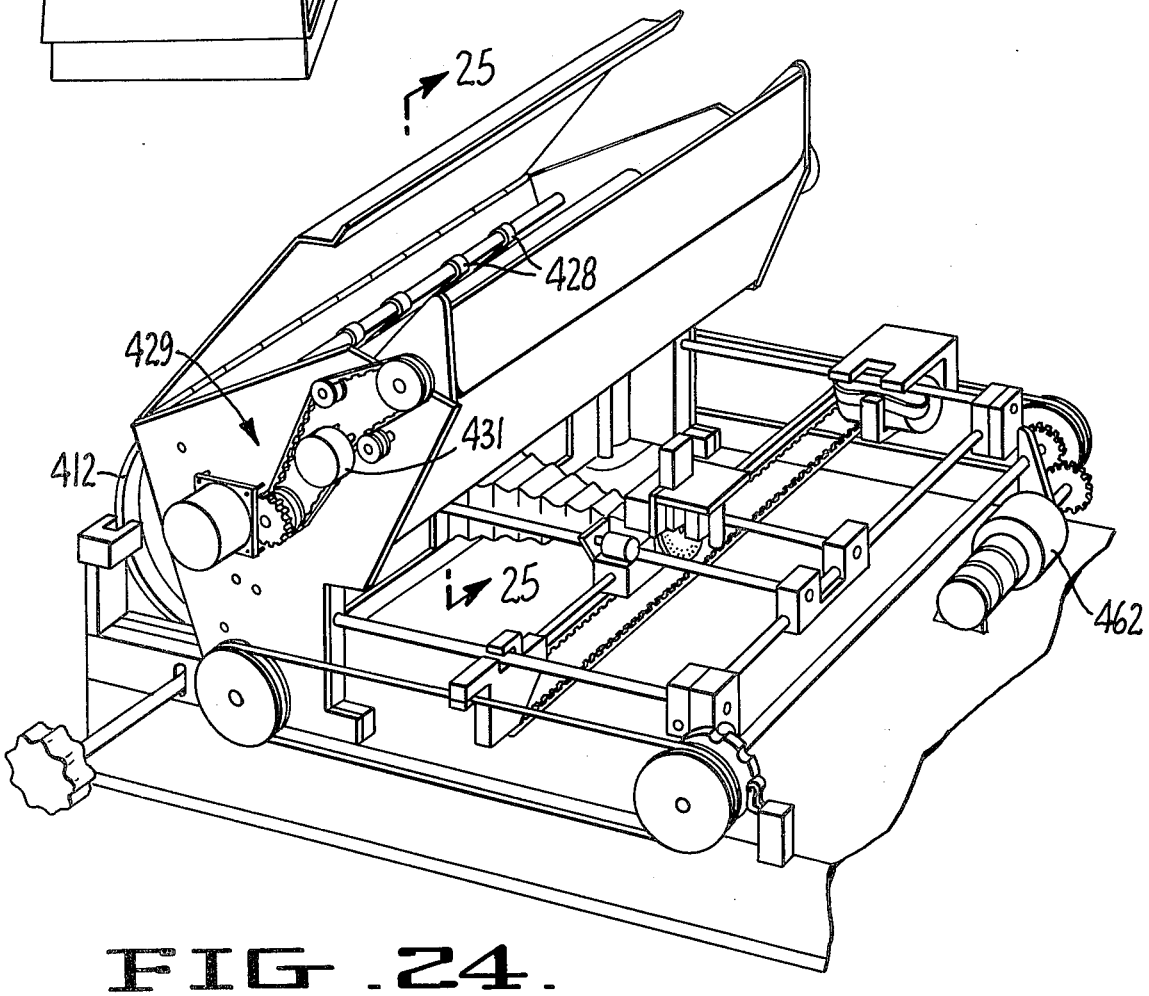
FIG. 24 is a perspective view of a portion of the machine shown in FIG. 23 with certain parts cut away to show the internal features of the machine.
Figures 25, 26:
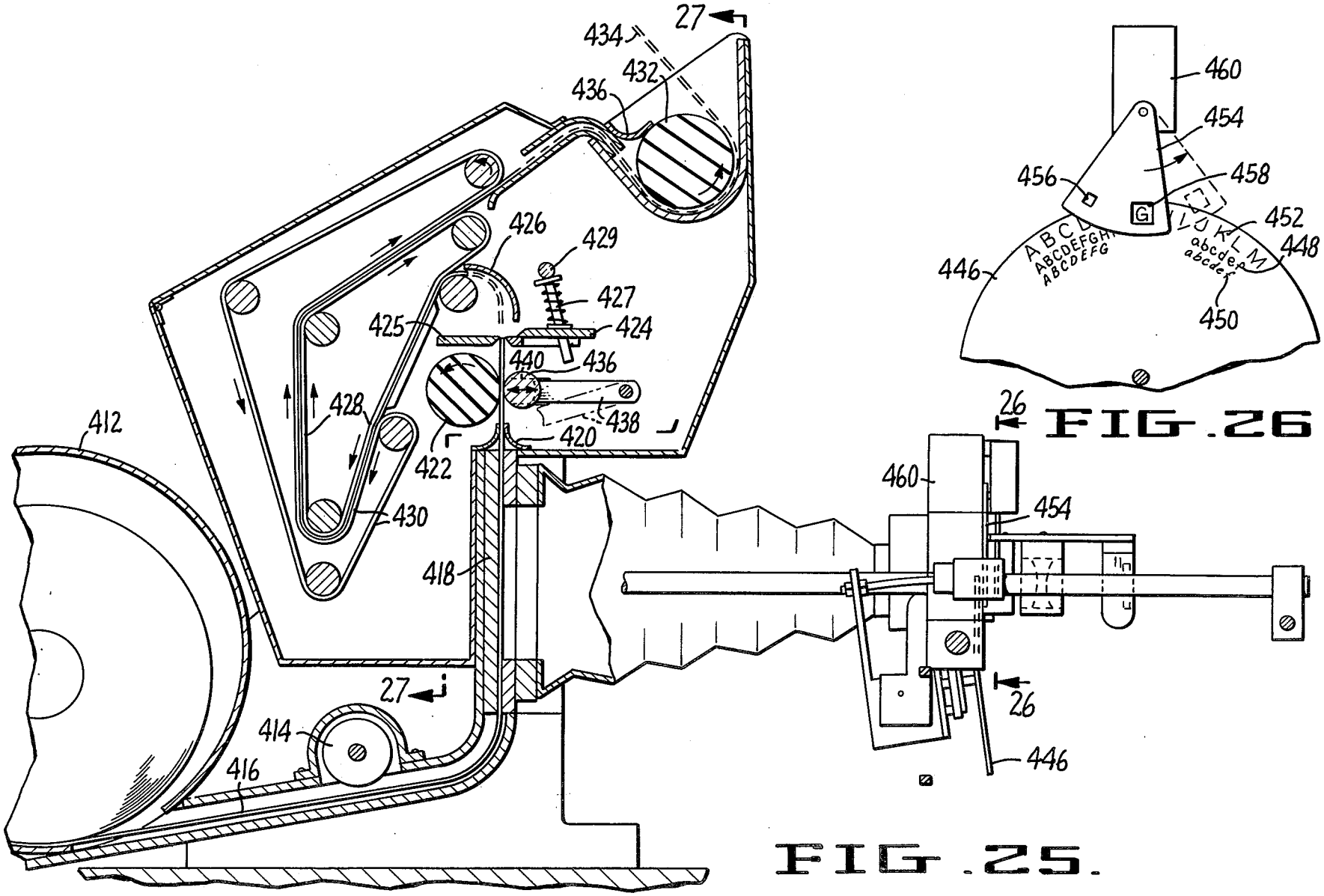
FIG. 25 is a section on the line 25—25 of FIG. 24.
FIG. 26 is a view on the line 26—26 of FIG. 25.
Figure 27:
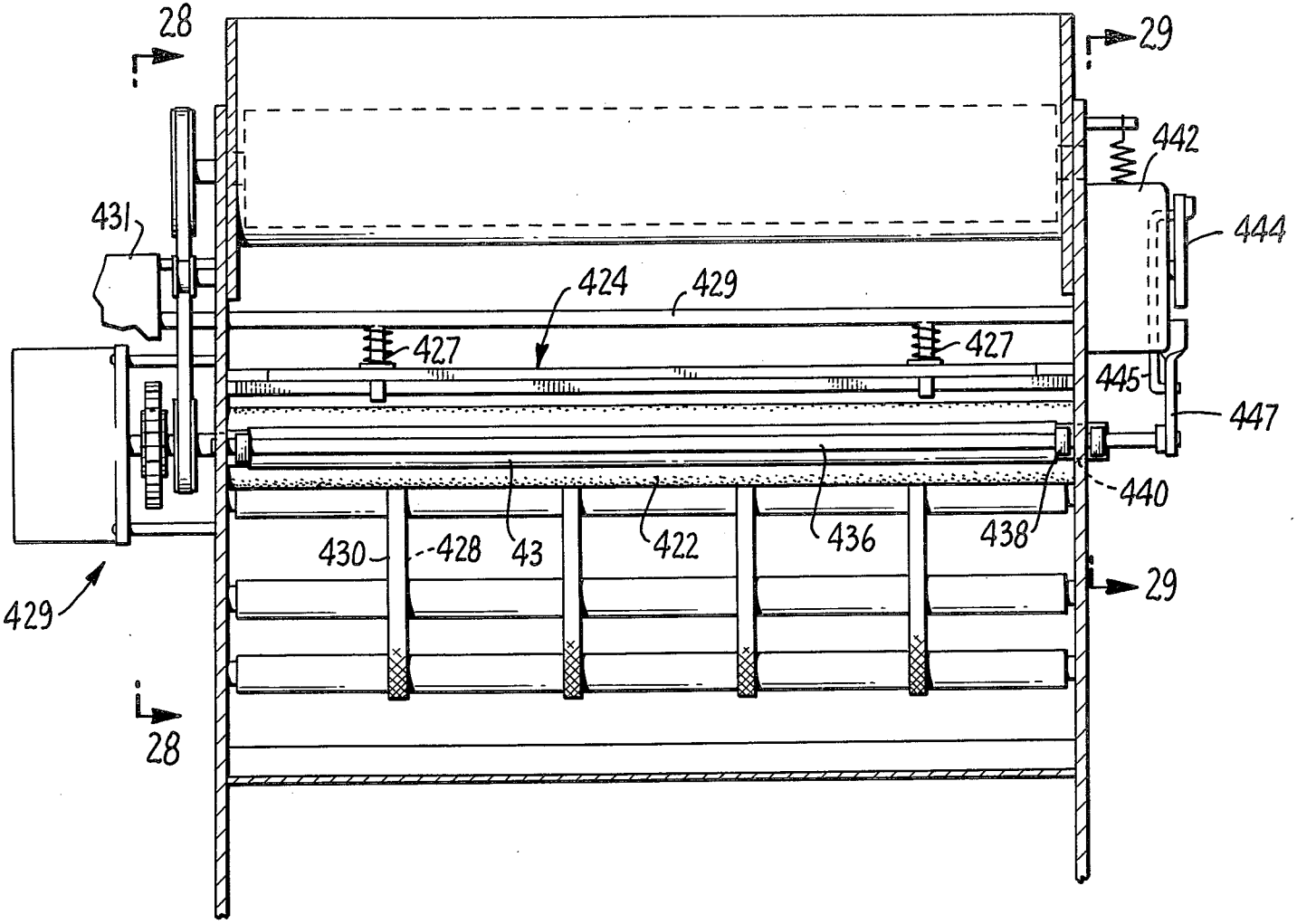
FIG. 27 is a view on the line 27—27 of FIG. 25.
Figure 29:
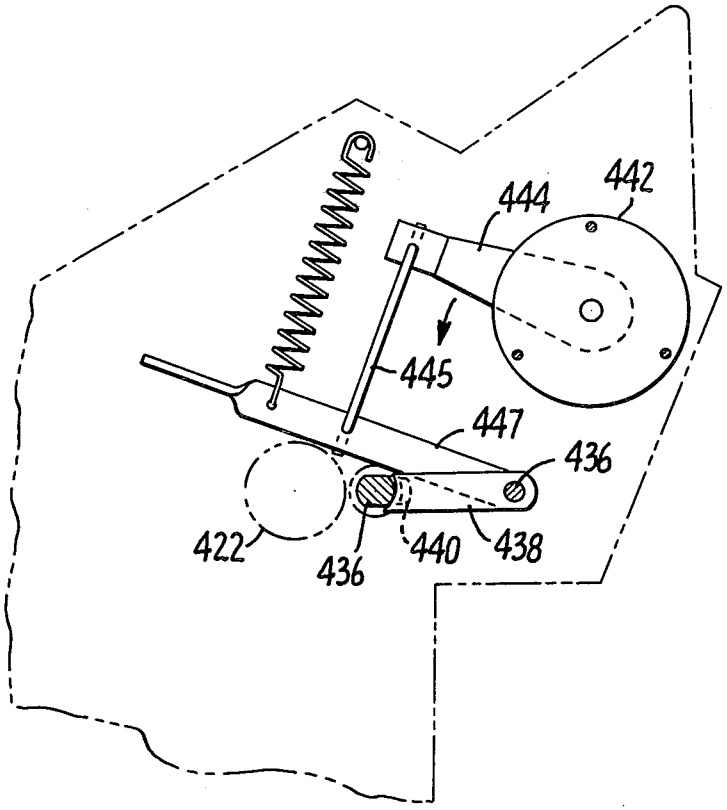
FIG. 29 is a side view on the line 29—29 of FIG. 27.
Figure 28:
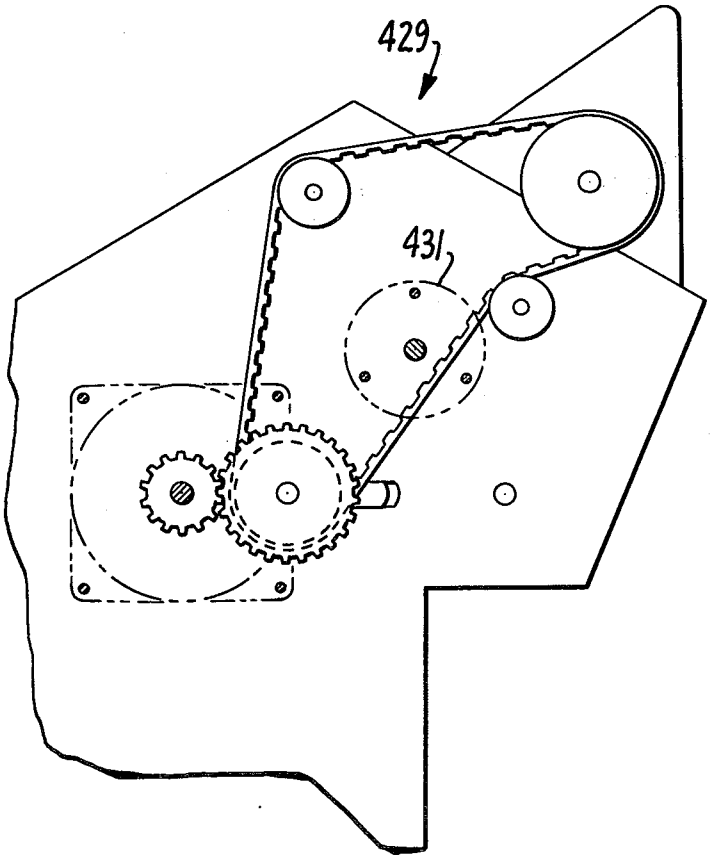
FIG. 28 is a side view on the line 28—28 of FIG. 27.

The paper advance system sequence of events will now be described particularly with reference to FIG. 22. At the start of a developing operation both forward (FWD) 402 and return flip-flop (FF) 404 are reset, $\overline{Q}$ is high in both cases, and motor and brakes are de-energized by motor controller 406. The paper transport is in zero position. FWD FF is set by closing 408 (start) and gate A1 (409) goes high and motor 230 starts running forward.

Figure 14:
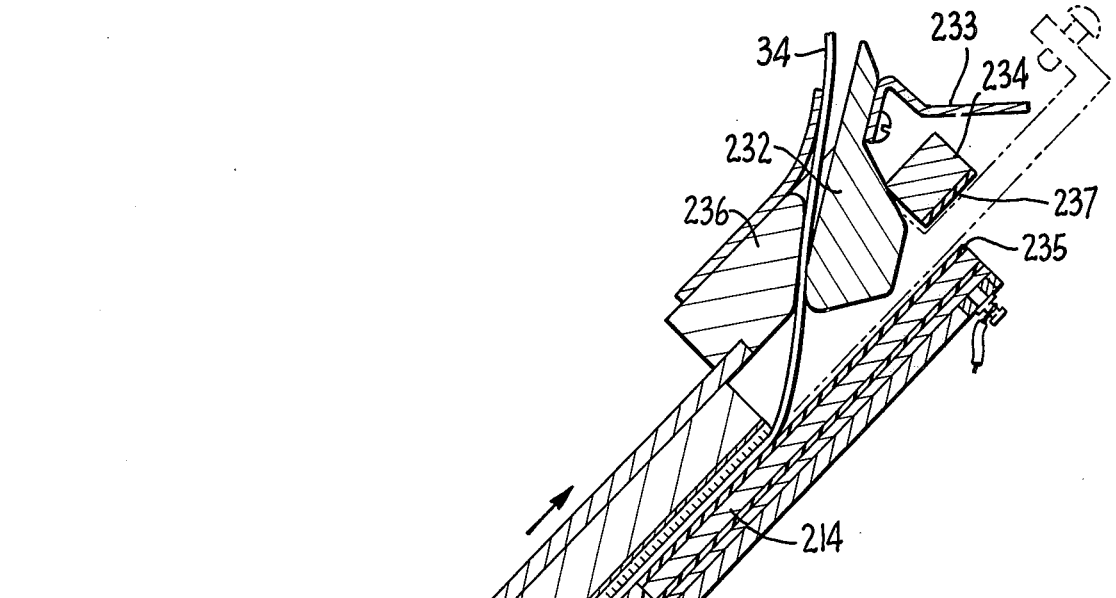
FIG. 14 is an enlarged side section of the paper advancing and developing system.
Figure 15:
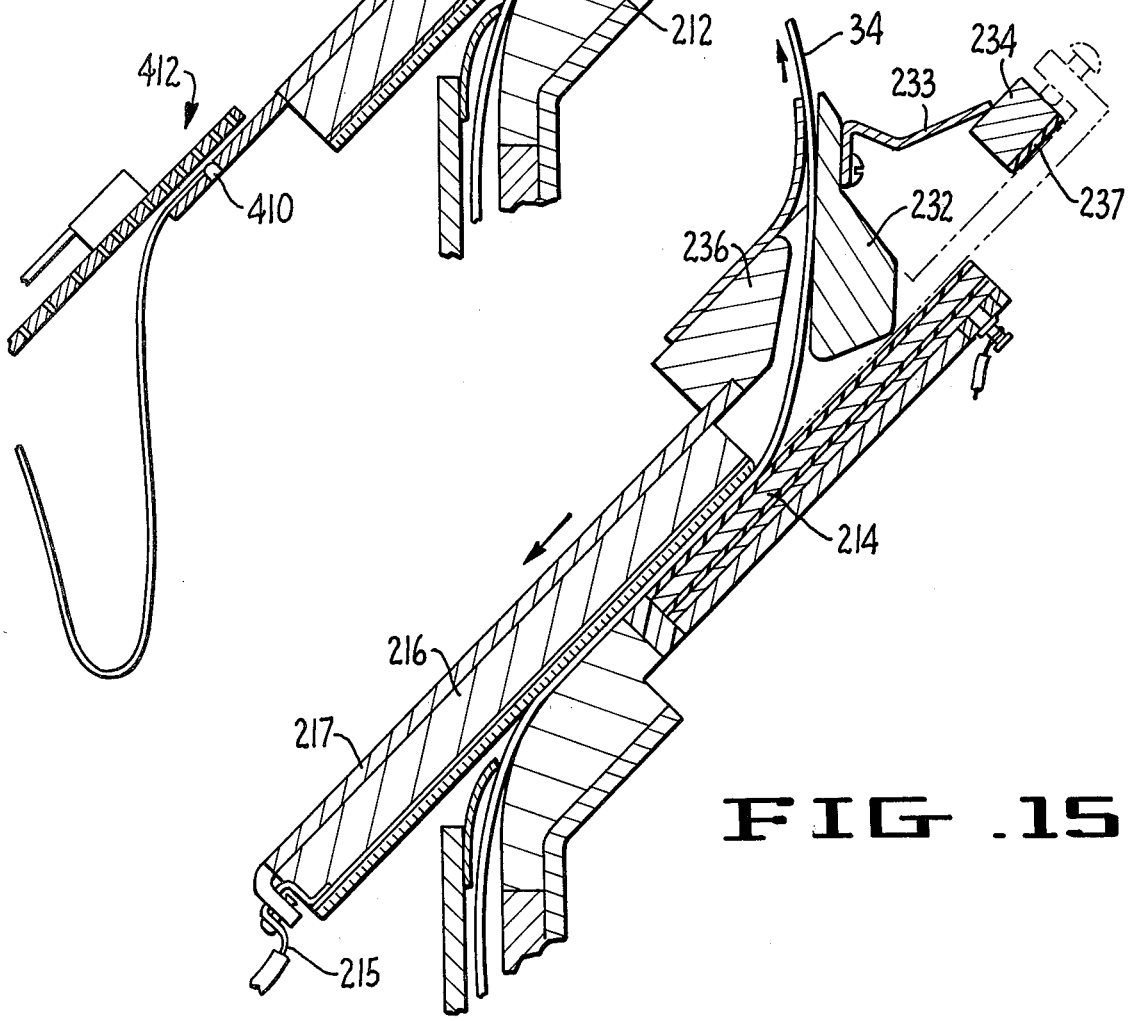
FIG. 15 is a view similar to FIG. 14 showing the motion of the parts.
Figure 16:
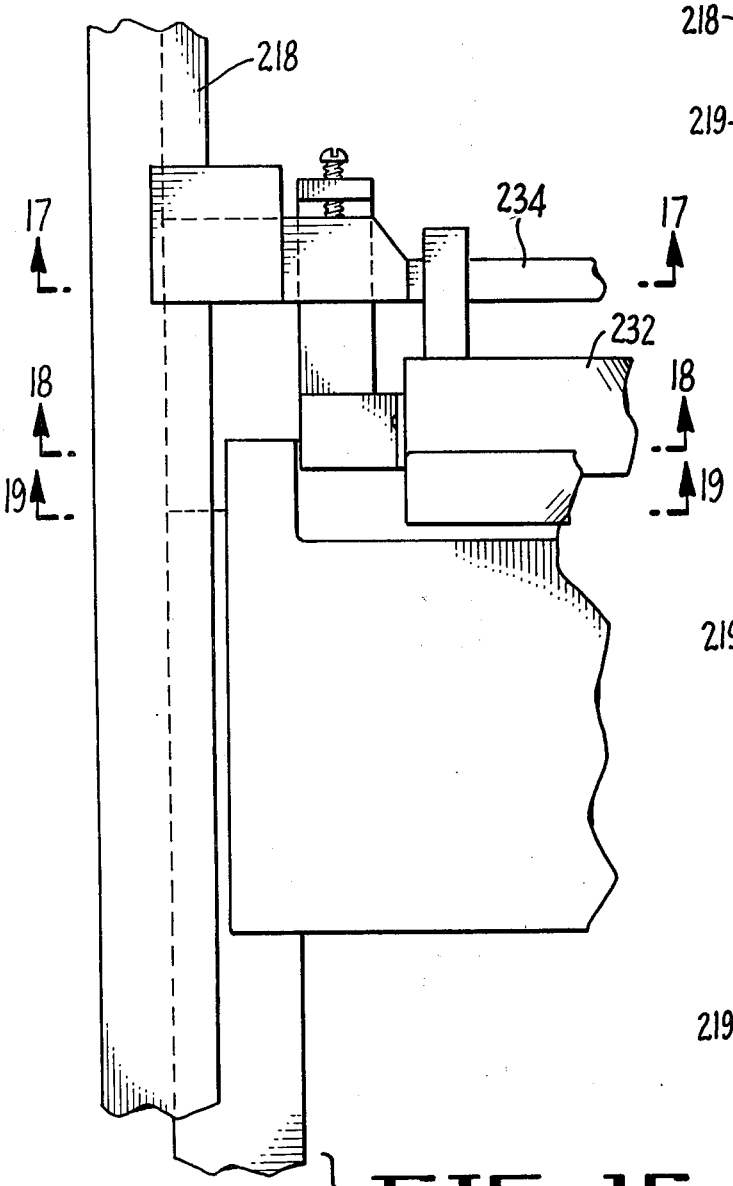
FIG. 16 is a section on the line 16—16 of FIG. 4.
Figure 17:
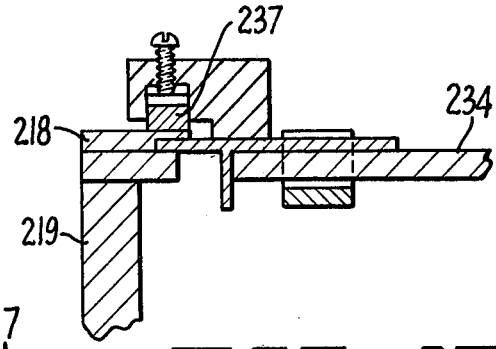
FIG. 17 is a section on the line 17—17 of FIG. 16.
Figure 18:
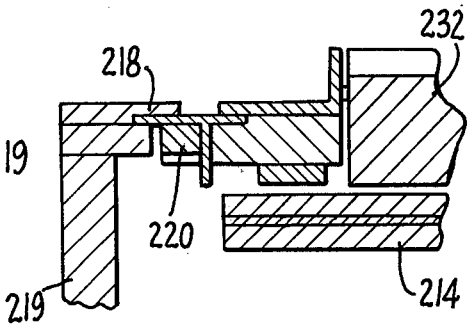
FIG. 18 is a section on the line 18—18 of FIG. 16.
Figure 19:
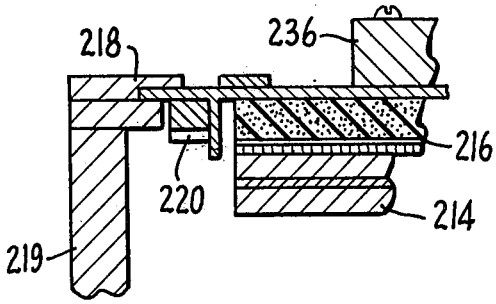
FIG. 19 is a section on the line 19—19 of FIG. 16.
Figure 20:
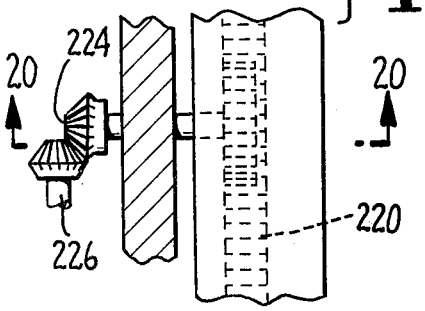
FIG. 20 is a section on the line 20—20 of FIG. 16.
Figure 20:
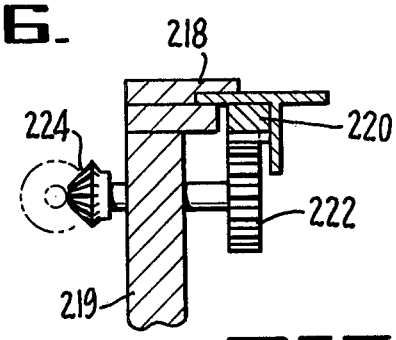

The paper transport (i.e. pad 216) moves until the light emitting diode 410 (LED) lines up with one of the photo diodes 412 which is connected through S2 and S3 to pulse shaper 1 (411). In the switch position shown this photo diode is the one corresponding to 10x magnification, large spacing. The location of these photo diodes is shown in FIG. 14.

The light from the LED causes a current in the photo diode which after shaping by the pulse shaper 411 resets the FWD FF 402.

The motor 230 is de-energized (Q of FWD FF goes low), brake 1 is activated ($\overline{Q}$ of FWD FF goes high), the paper transport stops in the selected (by S2 and S3) position, and the delay 416 is started.

After a suitable time interval determined by the motor controller brake 1 is deactivated.

At the end of the delay period, the delay circuit sets the return FF 404 and gate A2 (418) goes high so that the motor runs backward.

The paper transport moves backward until the LED 410 lines up with the zero position diode 413.

The light from the LED causes a current in the photodiode which after shaping by pulse shaper 2 (412) resets the return FF.

The motor is de-energized (Q of return FF 404 goes low), brake 2 is activated ($\overline{Q}$ of return FF goes high) and the paper transport stops in the zero position where it started from.

After a certain time interval the motor controller deactivates brake 2 and the paper advance system is back in its initial state.

The arrangement of the parts in this practical embodiment of the invention is such that the image projected on the paper is from two to ten times actual size of the font so that the variation in area size of a particular character can be from one to 25. This is a very substantial difference in size so that the machine is well adapted for printing advertising signs and the like wherein one wishes to have some lines in relatively small type and others in large type. Obviously, by proper selection of focal length and the like, these ratios can be shifted as desired.

A more advanced version of the machine is shown in FIGS. 23–29. Although this machine embodies the general mechanical structure previously described, it differs in several important respects. In the first place, a microcomputer with memory and display monitor unit is provided so that one can type an entire page and have it recorded on the workspace of a CRT, edit it, and then push a button whereupon the machine will print the entire page from the memory. Then the paper will be cut off and the entire page will be developed as a unit rather than on a line-by-line basis as previously described.

Referring now to FIGS. 23 through 29, the phototyper has a case 400 having the usual typewriter keyboard 402. The phototyper is connected by means of a cable 404 to a memory and display monitor unit 406. The display monitor unit 406 is a display tube of the usual CRT type, wherein the material is displayed as it is typed. After a page has been typed, as is later described in detail, one pushes the print button 410 whereupon the machine recalls the typed material from memory and prints it optically as previously described. As soon as the sheet is printed, it is developed.

As was previously mentioned, many of the mechanical parts of this version of the machine are the same as those previously described so they are not herein described in detail. The heat sensitive paper is stored in a light tight magazine 412 and is advanced by means of a drive roller 414. The paper 416 passes over platen 418 where it is held in position for exposure as was previously described. The paper then passes through a light seal 420 through the drive rollers 422. The paper then passes over the guillotine type cut off blade 424 and is then guided by deflector 426 between the two sets of endless belts 428 and 430. The amount of paper which can be held between the belts normally would represent one page as is displayed on the CRT. Thus, as the paper is exposed and advanced, it passes into storage between the belts 428 and 430 driven by a belt drive system 429. As soon as one page is completed, the guillotine 424 direct driven by cut off solenoid 431 cuts off the sheet and it then passes over the heated roller 432 where it is developed and is passed out of the machine in finished form at 434. A light seal 436 is provided at the entrance end of the heated roller. Thus, the development is done one sheet at a time rather than intermittently as previously described.

The guillotine knife 424 operates against a fixed member 425 and is caused to move by means of arm 427 which is attached to shaft 429. Shaft 429 is rotated by the rotary solenoid 431.

A pinch roller 436 is actuated by arm 438 which moves in the slot 440. Roller presses the paper against the drive roller 422 which is driven by paper advance motor 429 and must be disengaged when the machine is loaded with a new supply of paper. Arm 438 is actuated through the rotary solenoid 442 which is attached to arm 444 in the linkage rod 445 or a manual lever 447.

In order to be able to move the carriage in the much smaller steps now required for the smaller letter sizes and different styles and widths of letters, a ministepper movement has been devised that divides each normal step size in 31 uniform minature steps. Typical minimum step size of 24 mils is now 0.77 mils per ministep.

It was previously mentioned that more than one font can be employed when it is desired to have an extreme range of sizes or different styles of type. If more than one font type size is employed, it is necessary to provide some adjustable aperture means so that the light beam is restricted to the particular font size in use. Referring now to particularly FIGS. 25 and 26, a font 446 is shown, a typical font having small upper and lower case letters 448 and small upper case letters in italic or bold style 450, and large capitals 452 by way of example. The letters in each row are arranged in a statistical order that places letters that are used most often nearest to the center position, so that the average writing speed is accordingly increased. If two rows of characters are used, a two position shift solenoid is required. If a three row character font is used, a three position shift solenoid is needed. A rotating aperture plate 454 has two apertures, namely a small aperture 456 and a large aperture 458. The aperture plate 454 is connected to a rotary solenoid 460 so that either the small aperture 456 or the large aperture 458 can be brought into registration with the desired font. In this manner, an even larger range of sizes and various type styles can be provided in the machine of the present invention. In order to be able to print automatically as described before from memory when changes in point sizes are required, an electric magnification stepper motor 462 has been added that makes it possible to change magnification of letter sizes from the keyboard or from memory automatically.

Figure 30:
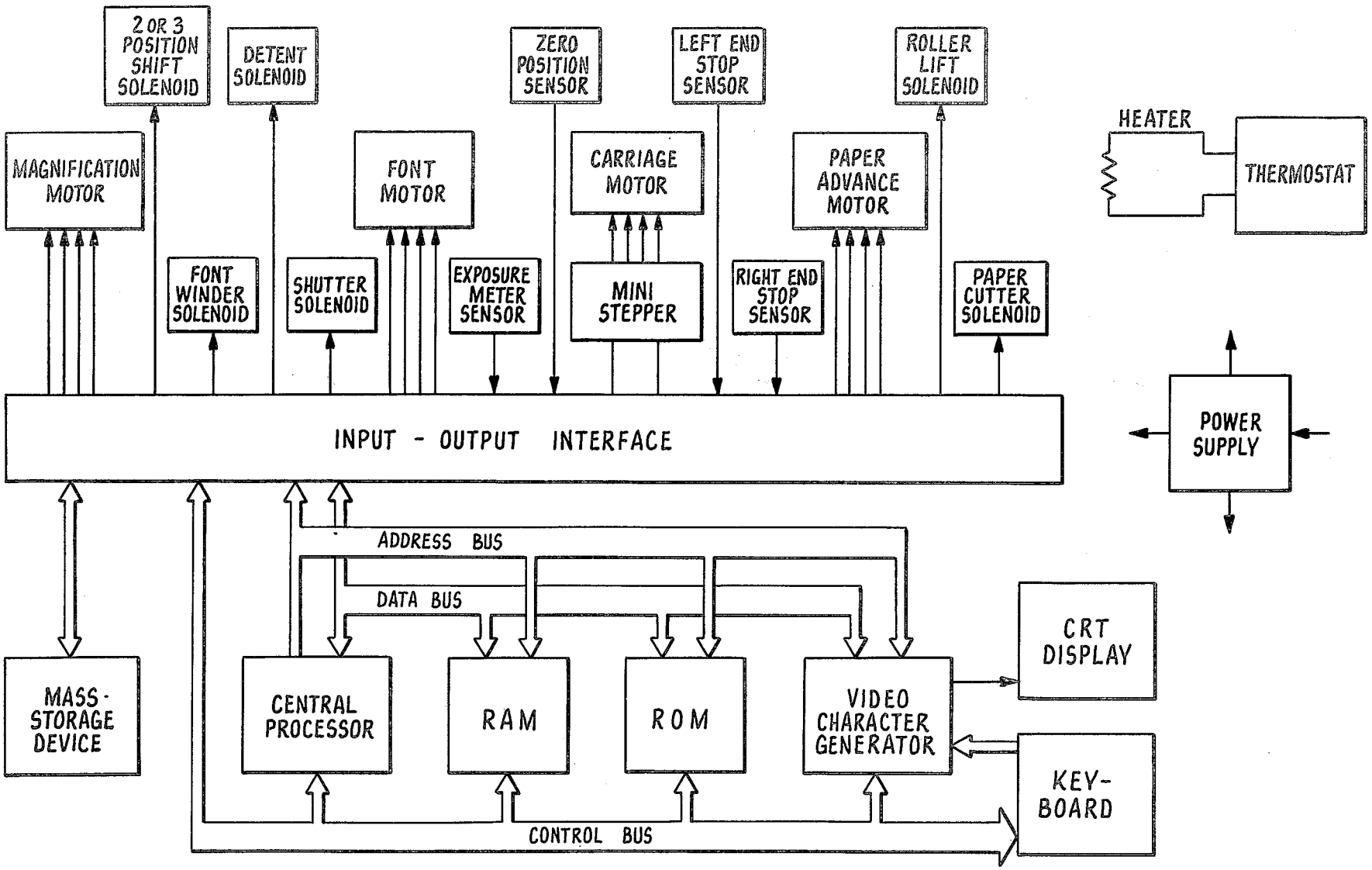
FIG. 30 is a block diagram.

In FIG. 30, there is shown a typical logic and control circuit for the version of the machine shown in FIGS. 23–29. The legends on the drawings are largely self-explanatory but in general the operation of the logic is as follows:

I. General Description of Basic Machine Operations

Striking a key on the keyboard places a code corresponding to the key into the video character generator which causes the CRT display to display the letter, associated with the code. The code is also transferred to the central processor unit (CPU) which initiates the printing of the letter.

First, the letter magnification is read. Then the font wheel is moved into position and stopped. The detent is energized, the shutter is opened, the exposure is measured, and when enough light has been admitted to the paper, the shutter is closed, and the detent is de-energized. Then the font wheel starts to run back until the zero position sensor senses that the font wheel is again in its starting position. At the same time as the font starts to return, the carriage motor starts to move the carriage according to the letter keyed in and the letter magnification. If the carriage arrives at the right endstop before it completes its movement, the carriage motor is stopped.

When the space bar is struck, no letter is printed or displayed, only the carriage moves. The carriage can be moved left or right by striking corresponding keys. When at the left stop, the CPU inhibits farther movement to the left. When at the right stop, the CPU inhibits farther movement to the right.

The CPU obtains the program instructions from the ROM. Temporary instructions as letter size and type, and leading are stored in RAM and displayed on top of the CRT screen.

II. Operational Modes

The machine operations or modes can be broken down into five different procedures. At any given time, the operator is either:

(a) typing
(b) editing
(c) printing
(d) developing
(e) saving and loading text

Each mode is entered keying in its corresponding code. This code is generated by either a dedicated key or a combination of keys.

A. Typing

When text (often referred to as a document) is typed into the machine, the typed characters appear on a large screen. The actual screen position of the next typed character is determined by the location of the cursor. The cursor is a little white square which appears somewhere on the screen. The cursor is used as a pointer which indicates where the next character will be placed. It will be placed in the location that the cursor currently occupies.

As a document is typed, the text is stored in a workspace. Since this workspace is considerably larger than one screen's worth of text, the screen displays only a portion of the workspace, namely the area that is currently being worked on. If an area of the document that is not currently on the screen needs work, the document may be moved up or down until the proper area of the document is displayed on the screen. Moving through the document is called scrolling. After the correct area of text is selected, the exact location within the area is selected by positioning the cursor.

The workspace area is limited. As text is typed in, the workspace will fill up. If this occurs, the current document should be stored on a diskette, and then erased from the workspace. The workspace is then freed up for more text entry.

B. Editing

The act of correcting and modifying text is called editing. Editing may be done while the document is being typed or after the entire document is entered.

Editing involves deleting, inserting, replacing, or moving single characters or groups of characters. The machine has a number of special commands for performing these functions. The cursor is used in editing as a pointer. An operator must position the cursor to the exact point where an edit is to be made and then perform the proper editing command. Any part of the text within the workspace may be edited. Text that has been entered and saves on diskette must be reloaded into the workspace before it can be edited.

C. Printing

The machine separates input (typing text) and output (printing text) into two distinct procedures. The obvious advantage of such a system is that documents are never printed until they are perfect. Another benefit of this type of a system is that a single piece of text can be printed in a variety of formats. At print time, an operator may choose to specify line length, character spacing, line spacing, right justification and a number of other printing characteristics.

A document must be in the workspace for it to be printed. A document stored on diskette must first be loaded into the workspace before it can be printed.

D. Developing

The development is started by keying in the corresponding command. First the papercutter solenoid is energized and the paper is cut. Then the cutter solenoid is de-energized and the roller lift solenoid is energized. Lifting the roller prevents moving unexposed paper from the carriage into printing position. The paper-advance motor is started and the paper to be developed is moved through the heat developer. The motor is stepped a number of steps which corresponds to the maximum size of a page plus a leader. After the paper to be developed has passed through the developer, the motor stops, and the roller lift solenoid is deenergized. The machine is then ready for printing and/or the next developing cycle.

E. Saving and loading a document

Once a document is entered, an operator may choose to store this document for future use. This is done by saving the text on floppy diskette 464. Documents that have been stored may be placed back into the workspace by commanding the system to load the diskette.

I claim:

1. A phototypesetter comprising in combination:
   a. a rotating circular font, said font having a plurality of characters on the periphery thereof;
   b. indexing means whereby said font can be stopped at a desired character;
   c. projection means including a light source and a movable lens whereby said font can be projected onto a focal plane;
   d. a first carriage carrying said font, said indexing means and said projection means, said first carriage moving said structure from side to side across said focal plane;
   e. a second carriage supporting said first carriage, said second carriage moving said first carriage at right angles to said focal plane whereby the size of the image projected on said focal plane can be varied;
   f. means for maintaining a heat developing paper at said focal plane and means for advancing and developing said heat sensitive paper.

2. A phototypesetter of claim 1 wherein said font is positioned on a shaft with a toothed wheel on said shaft, with one tooth for each upper and lower character on said font, and having first means for approximately positioning said font and having a detent member movably in and out of said toothed wheel, whereby said detent member precisely positions said font.

3. The phototypesetter of claim 1 wherein said font has transparent characters and the balance of the surface of the font is reflective, whereby heat will be reflected from the reflective surface of the font.

4. The phototypesetter of claim 1 having means for moving the position of said font relative to said focal plane and automatic means to move the lens relative to the font whereby the image is kept in focus on the focal plane regardless of the position of the font with respect to the focal plane.

5. The phototypesetter of claim 4 having the following additional structure:
   a. a carriage mounted for movement toward and away from said focal plane;
   b. said carriage carrying said font and said lens;
   c. a cam mounted parallel to the path of movement of said carriage;
   d. a cam follower mounted on said carriage;
   e. means connecting said cam follower to move said lens relative to the carriage in correlation with the movement of said carriage whereby
   f. the image cast by the font on the focal plane stays in focus as the font moves toward and away from said focal plane.

6. The phototypesetter of claim 1 having the following additional structure:
   a. a cassette for maintaining a supply of heat developing paper;
   b. means for feeding said paper to an exposure position;
   c. means for exposing said paper, one character at a time, to light passing through said font;
   d. means for heat developing said paper one line at a time.

7. The structure of claim 6 having a fixed heated plate and having a heated pad mounted over said heated plane and means for reciprocating said pad over said plate for drawing said paper over said heated plate.

8. The structure of claim 7 having means for varying the length of stroke of said heated pad.

9. The phototypesetter of claim 1 having the following additional structure:
   a. a light tight cassette for maintaining a supply of heat-developing paper;
   b. means for feeding said paper to an exposure position;
   c. means for exposing said paper to light passing through said font;
   d. light tight storage means for receiving a quantity of paper;
   e. means for severing said paper stored in said light tight chamber from said supply of heat developing paper; and
   f. means for passing said severed paper through heat developing means.

10. The phototypesetter of claim 1 wherein said rotating circular font has a plurality of rows of characters thereon and aperture means having variable apertures and means for positioning a desired aperture adjacent to a desired row of characters.

11. The structure of claim 1 wherein said first carriage includes means for moving said carriage in steps across said focal plane, each of said steps being smaller than the width of a character.

* * * * *